US009551121B2

(12) United States Patent
McCord

(10) Patent No.: US 9,551,121 B2
(45) Date of Patent: Jan. 24, 2017

(54) BASE INSERT FOR TRAFFIC DELINEATOR POSTS

(71) Applicant: Kevin Austin McCord, Kula, HI (US)

(72) Inventor: Kevin Austin McCord, Kula, HI (US)

( * ) Notice: Subject to any disclaimer, the term of this patent is extended or adjusted under 35 U.S.C. 154(b) by 0 days.

(21) Appl. No.: 14/844,746

(22) Filed: Sep. 3, 2015

(65) Prior Publication Data

US 2016/0115660 A1 Apr. 28, 2016

Related U.S. Application Data

(60) Provisional application No. 62/069,309, filed on Oct. 28, 2014.

(51) Int. Cl.
*A47B 91/00* (2006.01)

(52) U.S. Cl.
CPC ..... *E01F 9/692* (2016.02); *E01F 9/608* (2016.02)

(58) Field of Classification Search
CPC ..... E01F 9/013; E01F 9/658; E01F 9/692; E01F 9/608
See application file for complete search history.

(56) References Cited

U.S. PATENT DOCUMENTS

| | | | | |
|---|---|---|---|---|
| 3,391,660 | A * | 7/1968 | Stewart | A47B 3/00 108/150 |
| D287,820 | S * | 1/1987 | Bullen | D8/385 |
| 5,391,031 | A * | 2/1995 | Medal | B29C 65/08 411/180 |
| 6,685,154 | B1 * | 2/2004 | Blyth | 248/219.1 |
| 7,878,478 | B2 * | 2/2011 | Gumm | E04H 12/2238 135/121 |
| 9,102,092 | B2 * | 8/2015 | Mukith | B29C 47/0019 |
| 2008/0219763 | A1 * | 9/2008 | Jameson | E01F 9/0124 404/11 |

* cited by examiner

*Primary Examiner* — Amy Sterling
(74) *Attorney, Agent, or Firm* — Plager Schack LLP

(57) ABSTRACT

A detachable base insert for use with a traffic delineator post assembly to enhance durability of the post assembly is provided. The traffic delineator post assembly includes a tubular post member and a post base comprising a central opening able to receive the tubular post member. The base insert includes a tubular insert member disposed within an interior wall of the bottom portion of the tubular post member, and a base ring coupled to a bottom portion of the tubular insert member. The base ring serves as a barrier between the bottom of the tubular post member and the ground surface, thereby minimizing surface wear of the tubular post member. The detachable base insert replaces a worn out base retention ring on the tubular post member.

5 Claims, 4 Drawing Sheets

BASE INSERT FOR TRAFFIC DELINEATOR POSTS

RELATED APPLICATION

The application claims priority to provisional patent application U.S. Ser. No. 62/069,309 filed on Oct. 28, 2014, the entire contents of which is herein incorporated by reference.

BACKGROUND

The embodiments herein relate generally to traffic delineator posts or cones.

Delineator posts are used in a variety of locations such as roadways, sidewalks or other fields to direct vehicular and pedestrian traffic. The delineator posts typically comprise a post member having a highly visible color such as orange and a weighted base member. The weighted base member has a central opening that receives the post member. Once the weighted base member is placed over the post member and positioned to contact the ground, the post member is retained in a vertical position.

Current delineator posts comprise a bottom ring, also known as a base retention ring, which contacts the ground when in use. Over time, the bottom ring wears out, as the delineator cone is often dragged along an abrasive ground surface. This renders the delineator post ineffective and/or unusable in certain applications. In many instances, individuals have to discard these worn posts and purchase new ones. This is impractical and not cost effective.

As such, there is a need in the industry for a base insert for use with traffic delineator posts that replaces the existing bottom ring after it becomes worn out. This enhances the lifetime and durability of the traffic delineator post.

SUMMARY

A detachable base insert for use with a traffic delineator post assembly is provided. The traffic delineator post assembly comprises a tubular post member and a post base comprising a central opening configured to receive the tubular post member. The base insert is configured to couple to a bottom portion of the post member to prevent contact between the tubular post member and a ground surface, thereby reducing wear on the tubular post member. The base insert comprises a tubular insert member configured to be disposed within an interior wall of the bottom portion of the tubular post member, and a base ring coupled to a bottom portion of the tubular insert member, wherein the base ring is configured to serve as a barrier between the bottom of the tubular post member and the ground surface, thereby minimizing surface wear of the tubular post member. The detachable base insert effectively replaces a worn out base retention ring on a delineator post.

In certain embodiments, a plurality of protrusions is disposed on an outer surface of the tubular post member. In certain embodiments, each protrusion in the plurality of protrusions comprises a trapezoidal-shaped wedge.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
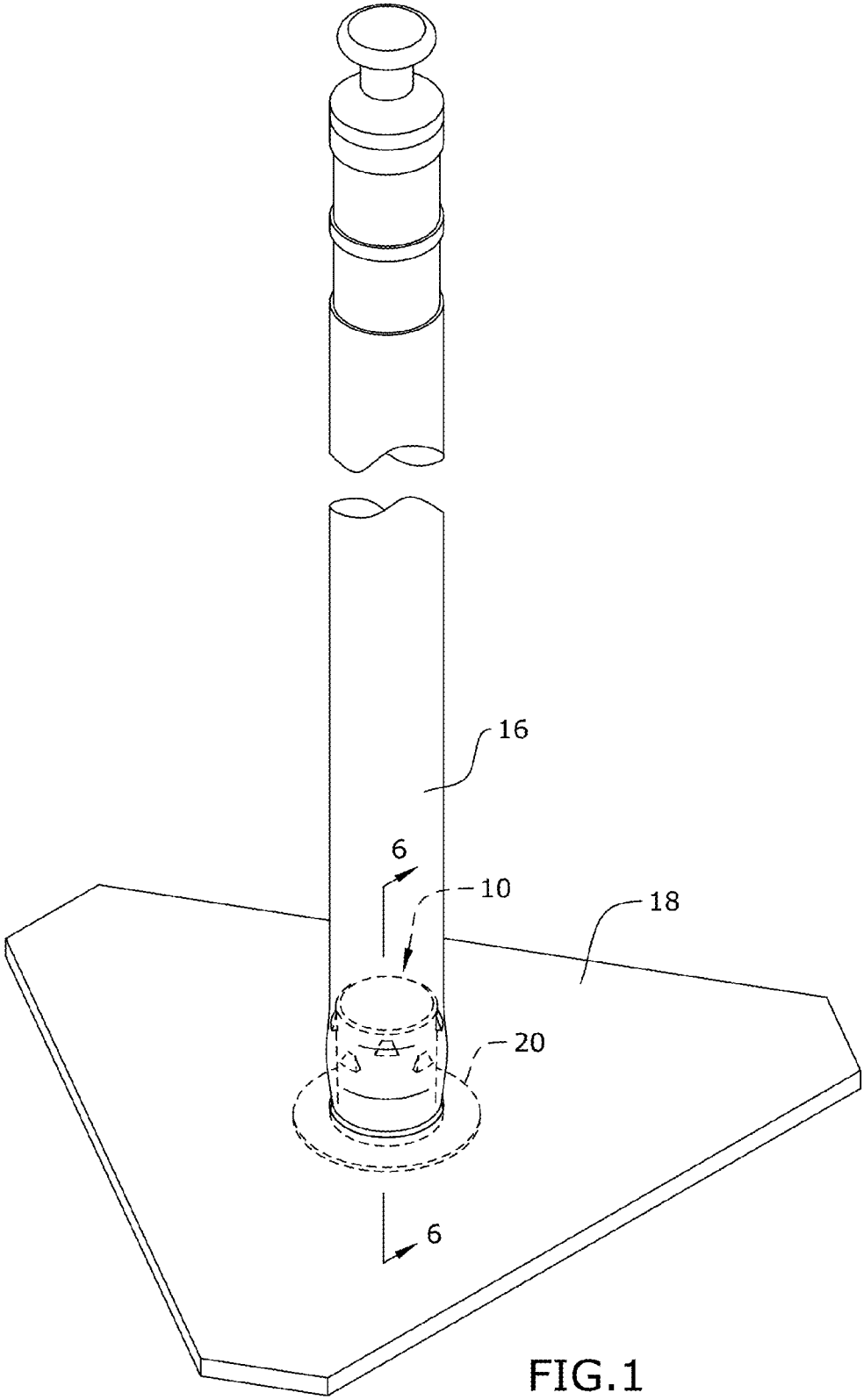
FIG. 1 depicts a perspective view of certain embodiments of the base insert in use.
Figure 2:
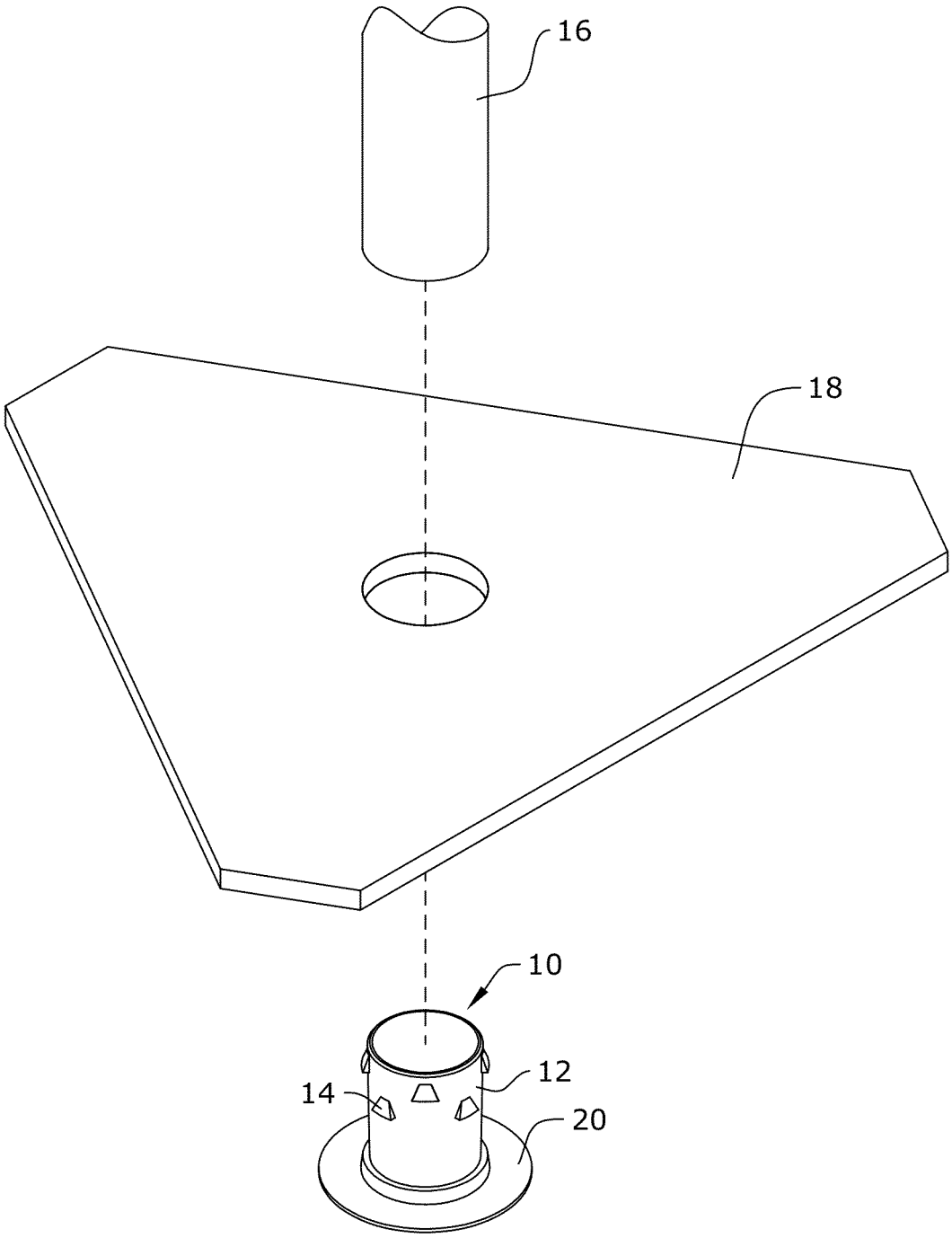
FIG. 2 depicts an exploded view of certain embodiments of the base insert in use.

As depicted in FIGS. 1-2, base insert 10 is configured for use with delineator post 16 and post base 18. Base insert 10 comprises tubular member 12, protrusions 14 and ring 20. Base insert 10 is configured to be inserted within the bottom of delineator post 16, which is a tubular member. This is generally completed after the existing bottom ring (not shown) of delineator post 16 is worn out. Once base insert 10 is inserted within delineator post 16, post base 18 is disposed over delineator post 16 and base insert 10. Post base 18 comprises a central opening that receives delineator post 16. It shall be appreciated that delineator post 16 and post base 18 may have variable sizes, shapes and colors.

Figure 3:
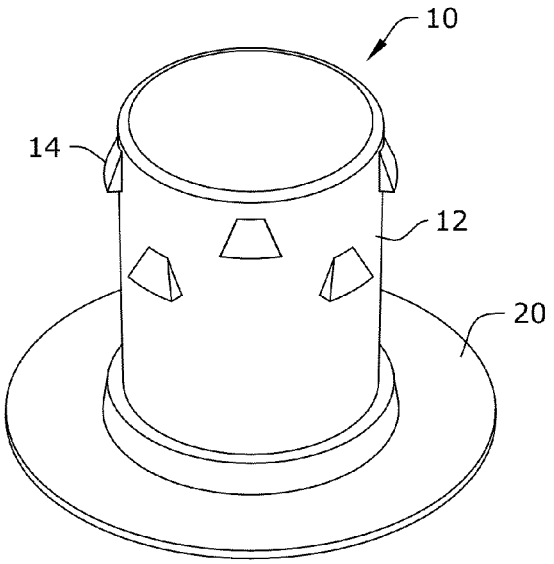
FIG. 3 depicts a perspective view of certain embodiments of the base insert.
Figure 4:
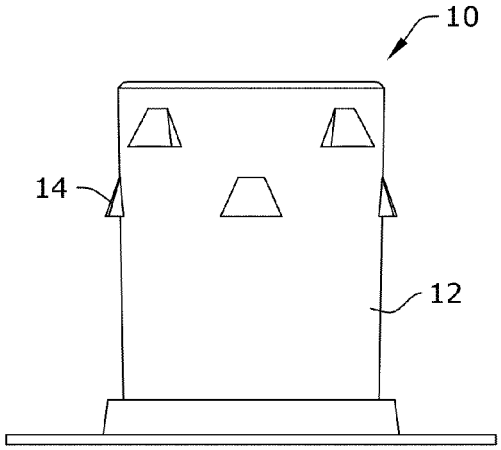
FIG. 4 depicts a side view of certain embodiments of the base insert.
Figure 5:
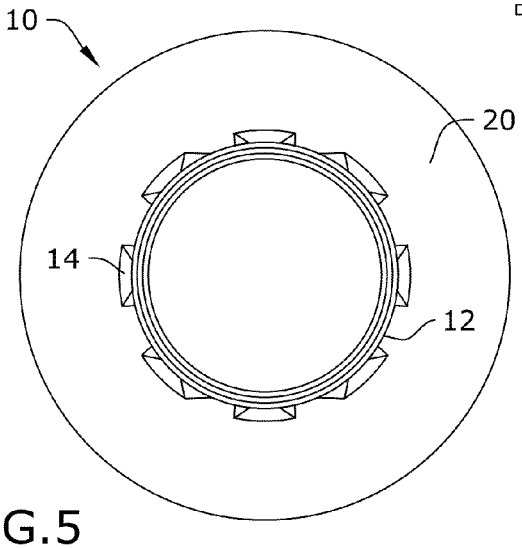
FIG. 5 depicts a top view of certain embodiments of the base insert.

As depicted in FIGS. 3-5, base insert 10 comprises tubular member 12, which is preferably cylindrical in shape and having a diameter of approximately 3.77 inches. In one embodiment, a plurality of protrusions 14 is disposed on the outer surface of tubular member 12. Each protrusion 14 preferably has a trapezoidal-shaped wedge with a height of approximately 0.54 inches. However, dimensions of each protrusion 14 may vary.

In a preferred embodiment, protrusions 14 are divided into a first set of protrusions aligned together and positioned proximate a top edge of tubular member 12, and a second set of protrusions aligned together and positioned on an intermediate portion of tubular member 12. Protrusions 14 are oriented such that the protrusions in the first set are not aligned with the protrusions in the second set. Although the figures depict four protrusions in each set, it shall be appreciated that any alternative number of protrusions may be used instead.

Ring 20 is coupled to the bottom of tubular member 12. In one embodiment, ring 20 comprises a step portion positioned at the junction between tubular member 12 and ring 20. The remaining portion of ring 20 is configured to lay flat against a ground surface.

It shall be appreciated that base insert 10 may be made from any materials known in the field such as high-density polyethylene or an alternative plastic-type material. Tubular member 12 and ring 20 may be a single continuous component or separate components joined together. The final assembly of tubular member 12 and ring 20 comprises a height of approximately 5.15 inches. However, the dimensions of base insert 10 may vary to accommodate different sized delineator posts 16 and/or post bases 18.

Figure 6:
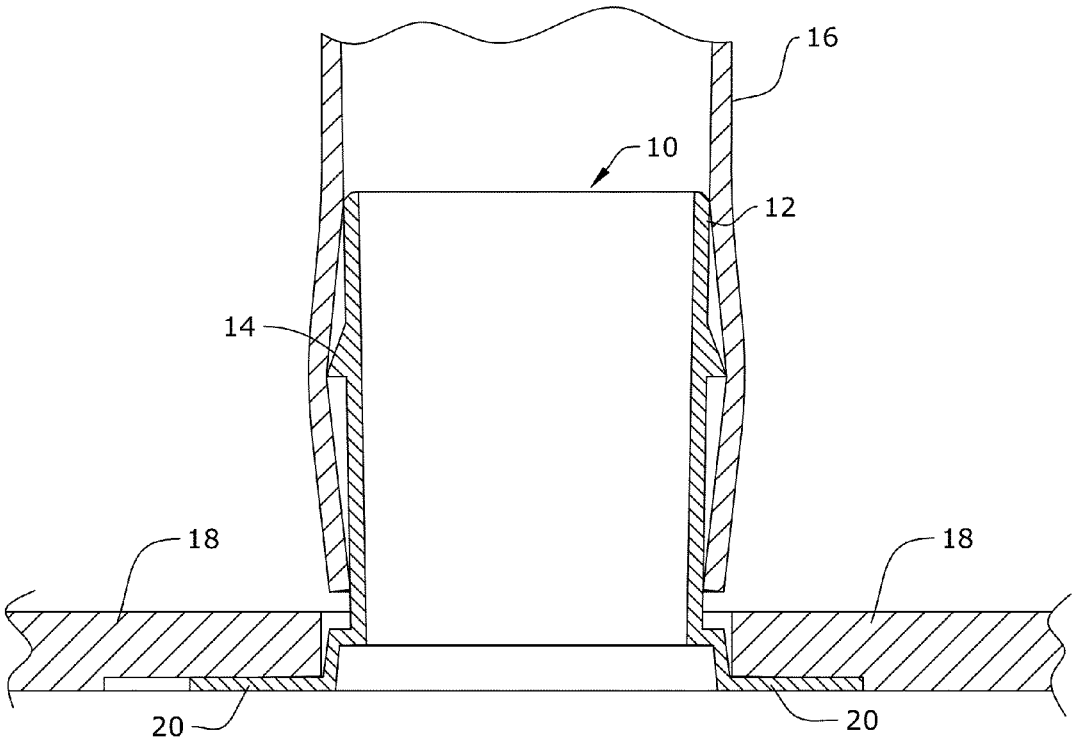
FIG. 6 depicts a section view of certain embodiments of the base insert taken along line 6-6 in FIG. 1.

To operate base insert 10, tubular member 12 is inserted into the bottom of delineator post 16. Protrusions 14 on tubular member 12 contact the interior wall of delineator post 16. This enhances friction between tubular member 12 and delineator post 16 and helps to secure the components together. Post base 18 is disposed over base insert 10 and delineator post 16 as depicted in FIG. 6. In this configuration, base insert 10 serves as a barrier between the bottom of delineator post 16 and the ground surface, thereby minimizing surface wear of delineator post 16. It shall be appreciated that base insert 10 can be easily detached from delineator post 16 and replaced by a new base insert, if desired. Base insert 10 is beneficial because it replaces a worn out base retention ring on a delineator post.

It shall be appreciated that the components of base insert 10 described in several embodiments herein may comprise any alternative known materials in the field and be of any color, size and/or dimensions. It shall be appreciated that the components of base insert 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A detachable base insert for use with a traffic delineator post assembly, the traffic delineator post assembly comprising a tubular post member and a post base comprising a central opening configured to receive the tubular post member, the base insert configured to couple to a bottom portion of the post member to prevent contact between the tubular post member and a ground surface, thereby reducing wear on the tubular post member, the base insert comprising:

a tubular insert member configured to be disposed within an interior wall of the bottom portion of the tubular post member;

a plurality of protrusions disposed on the tubular insert member along a pathway extending an entire circumference of the tubular insert member, the plurality of protrusions configured to contact the interior wall and deform the tubular post member to enhance friction between the protrusions and tubular post member, thereby improving retention of the tubular insert member within the tubular post member; and a base ring coupled to a bottom portion of the tubular insert member, wherein the base ring is configured to serve as a barrier between the bottom of the tubular post member and the ground surface, thereby minimizing surface wear of the tubular post member.

2. The base insert of claim 1, wherein the plurality of protrusions comprises a first set of protrusions and a second set of protrusions, wherein the first set of protrusions are aligned together and located proximate an upper edge of the tubular insert member, wherein the second set of protrusions are aligned together and located on an intermediate portion of the tubular insert member.

3. The base insert of claim 2, wherein the protrusions in the first set are not aligned with the protrusions in the second set.

4. The base insert of claim 3, wherein each protrusion in the plurality of protrusions comprises a trapezoidal-shaped wedge.

5. A detachable base insert for use with a traffic delineator post assembly, the traffic delineator post assembly comprising a tubular post member and a post base comprising a central opening configured to receive the tubular post member, the base insert configured to couple to a bottom portion of the post member to prevent contact between the tubular post member and a ground surface, thereby reducing wear on the tubular post member, the base insert consisting of:

a tubular insert member configured to be disposed within an interior wall of the bottom portion of the tubular post member;

a plurality of protrusions disposed on the tubular insert member along a pathway extending an entire circumference of the tubular insert member, the plurality of protrusions configured to contact the interior wall and deform the tubular post member to enhance friction between the protrusions and tubular post member, thereby improving retention of the tubular insert member within the tubular post member; and a base ring coupled to a bottom portion of the tubular insert member and comprising a step portion located at a junction of the tubular insert member and base ring, the step portion configured to enhance stability of the tubular insert member within the central opening of the post base, wherein the base ring is configured to serve as a barrier between the bottom of the tubular post member and the ground surface, thereby minimizing surface wear of the tubular post member.

* * * * *